United States Patent [19]

Piepenbreier

[11] Patent Number: 4,498,562

[45] Date of Patent: Feb. 12, 1985

[54] DISC BRAKE ARRANGEMENT FOR RAIL VEHICLES

[75] Inventor: Ernst Piepenbreier, Essen, Fed. Rep. of Germany

[73] Assignee: Thyssen Industrie AG, Fed. Rep. of Germany

[21] Appl. No.: 324,066

[22] Filed: Nov. 23, 1981

[30] Foreign Application Priority Data

Dec. 17, 1980 [DE] Fed. Rep. of Germany ..... 3047412

[51] Int. Cl.[3] ..... B61C 9/50; B61F 3/04; B61H 1/00

[52] U.S. Cl. ..... 188/58; 74/665 GC; 105/131; 105/135; 105/136

[58] Field of Search ..... 105/131, 135, 136, 130, 105/132.1, 133, 137; 188/58, 59; 74/665 GC; 180/65.6, 65.7

[56] References Cited

U.S. PATENT DOCUMENTS

| | | | |
|---|---|---|---|
| 767,865 | 8/1904 | Brown | 188/58 |
| 1,667,565 | 4/1928 | Radcliffe | 105/130 X |
| 2,106,843 | 2/1938 | Hahn | 105/130 |
| 2,213,349 | 9/1940 | Seibold | 105/130 X |
| 3,455,251 | 7/1969 | Lich | 105/135 |
| 3,626,862 | 12/1971 | Korn et al. | 105/131 |
| 4,130,065 | 12/1978 | Susdorf et al. | 105/131 |

FOREIGN PATENT DOCUMENTS

| | | | |
|---|---|---|---|
| 1047825 | 12/1958 | Fed. Rep. of Germany | 105/130 |
| 1127934 | 4/1962 | Fed. Rep. of Germany | 105/135 |

*Primary Examiner*—Randolph Reese
*Assistant Examiner*—Howard Beltran
*Attorney, Agent, or Firm*—McGlew and Tuttle

[57] ABSTRACT

A brake arrangement is disclosed for rail vehicles which include two track wheel sets having two wheels connected by a shaft. A multi-stage reduction gear is connected to each track wheel shaft. The two multi-stage reduction gears are connected to an electric motor which has an armature shaft extending in the direction of movement of the rail vehicle. Each multi-stage reduction gear has at least one intermediate power transmission shaft which extends out of a housing of the reduction gear. At least one disc brake is connected to each intermediate shaft at a position outside the reduction gear housing. A caliper arrangement with calipers and caliper actuators is rigidly connected to the housing and engages the disc so that there is no relative movement between the disc and the housing during operation of the rail vehicle.

1 Claim, 2 Drawing Figures

DISC BRAKE ARRANGEMENT FOR RAIL VEHICLES

FIELD AND BACKGROUND OF THE INVENTION

The present invention relates in general to rail vehicles and in particular to a new and useful disk brake arrangement for a rail vehicle having a multi-stage reduction gear with an intermediate shaft which carries a disk brake, the calipers and mechanism to activate the calipers being fixed to a housing of the reduction gear.

Disc brakes of rail vehicles usually act directly on the track wheel, i.e. the track wheels are already designed as brake discs and are engaged by breaking jaws. Such an arrangement considerably increases the weight of the track wheel and thus of the unsprung masses of the rail vehicle. If now, in order to reduce the mass of the wheel set, the brake mechanism with its braking jaws, its brake cylinders, and so on, is suspended from the sprung portion of the vehicle, disadvantageous relative movements between the parts of the braking system occur during operation.

This drawback is certainly eliminated in a braking mechanism in which the brake disc is driven from the track wheel axle through universal-joint shafts and through any kind of transmission, and mounted horizontally in the sprung frame, in accordance with German AS No. 10 47 825. Quite aside from the fact that this prior art arrangement has been developed for small-wheel vehicles, which calls for some accommodation of the brake disc whose diameter then is not limited to that of the track wheel, this design is a multipart arrangement requiring a separate drive of the brake disc and a separate mounting thereof.

SUMMARY OF THE INVENTION

The present invention is directed to a reduction of the unsprung masses of the entire drive by means of a brake arrangement of the above mentioned kind in which the disc brake is designed with a small number of parts and in such a manner that these parts do not execute any movements relative to each other.

Accordingly, an object of the present invention is to provide a brake arrangement for a rail vehicle comprising at least one track wheel set having a track wheel shaft, a multi-stage reduction gear unit connected to said wheel shaft having a housing and at least one intermediate power transmission shaft rotatably mounted therein and extending therefrom, at least one brake disc connected to said intermediate shaft, and caliper structure engageable with the disc to stop rotation thereof and connected directly to the housing. This arrangement eliminates any relative motion between the brake disc and the braking jaws which would be caused by the sprung suspension of the vehicle truck. The braking jaws can thus be mounted in a mechanically much simpler way. The brake disc rotates within a torque range which is reduced relative to that of the track wheels by the reduction factor of the transmission stages following the intermediate shaft, and within a speed range which is increased by the same factor. This makes it possible to substantially reduce the size of the disc and the mechanism producing the braking force. The masses are further reduced if brakes are provided on both ends of the intermediate shaft. Then, advantageously, the intermediate shaft can be designed as the carrier of a bevel gear and a spur pinion of a two-stage miter gearing comprising a fast bevel gear stage and a lower speed spur pinion stage.

Preferably, the brake disc is made in one piece. No problems arise therefore with the exchange of a worn disc, since the disc can be demounted from the shaft end without having to remove anything from the transmission or the truck. As compared to the prior art, forcing off or on operations are no longer needed. This means that not only labor costs are saved, but also risks are substantially reduced with parts which hitherto had to be forcibly removed or demounted, such as axles, track wheels, and bearings.

The inventive braking arrangement may be applied, with a particular advantage, to a double axle drive where the wheel sets are mounted on a truck or frame and the rigid axle shafts then form the output shafts of the spur gear stage of the respective miter gearing, and where an electric motor extending in the travel direction is supported between the wheel sets and carries, on its opposite ends, the miter gearing units which are flanged thereto.

Another object of the invention is thus to provide a brake arrangement for a rail vehicle which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to accompanying drawings and descriptive matter in which a preferred embodiment of the invention is illustrated.

DESCRIPTION OF THE PREFERRED EMBODIMENT

Figure 1:
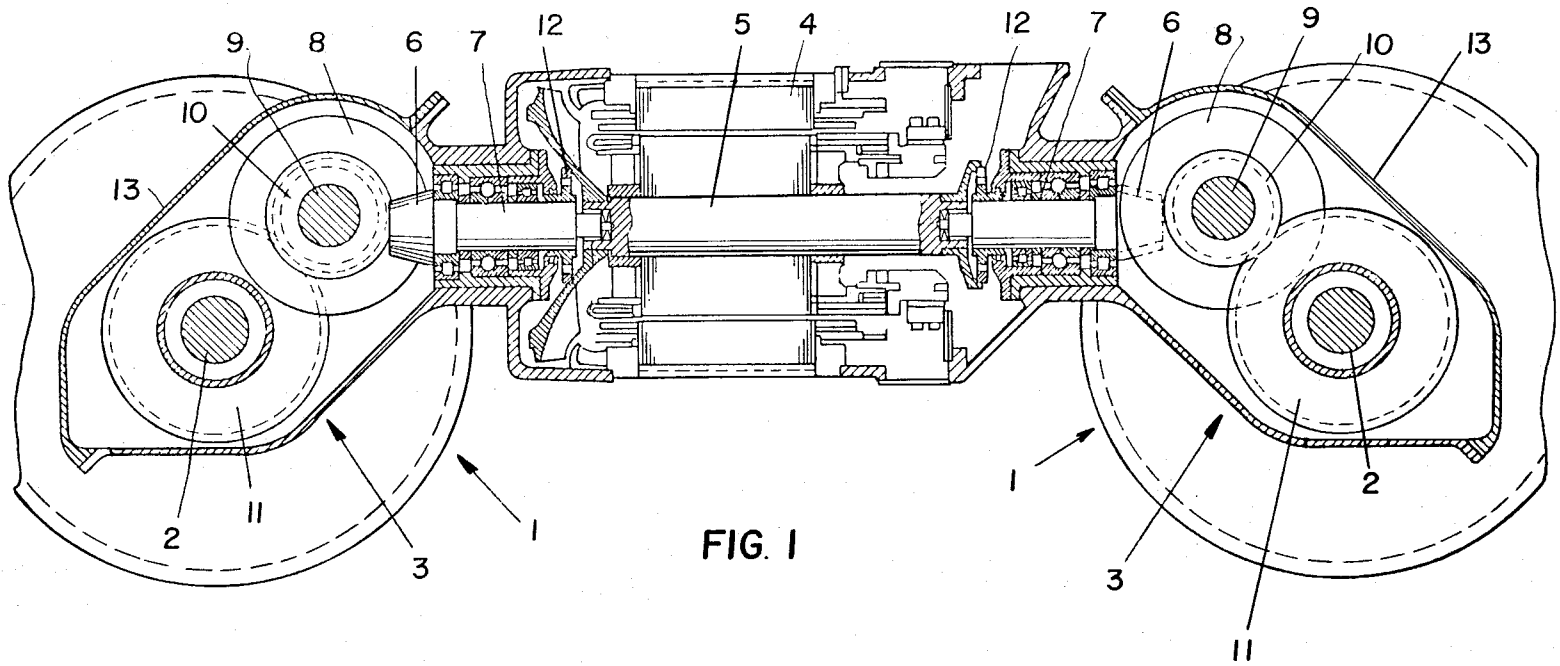
FIG. 1 is a side sectional view, partially in elevation of a brake arrangement according to the invention for a rail vehicle showing a double axle drive including an electric motor.

Referring to the drawings in particular, the invention embodied therein comprises a double-axle drive with a brake arrangement which includes a disc brake connected to the intermediate shaft of a multi-stage gear reduction provided between an electric motor and one or more wheel sets of a rail vehicle.

As seen in FIG. 1, a double axle drive comprises two wheel sets 1, a two-stage miter gearing unit 3 mounted on each axle shaft 2 of the wheel set for driving the same, and an electric motor 4 whose armature shaft 5 extends in the travel direction and carries on its ends the miter gearing units 3.

Each mite gearing 3 comprises a bevel gear stage including a pinion 6 which is provided on the end of a drive shaft or bevel pinion shaft 7 of the gearing and meshes with a bevel gear 8. The shaft 9 of bevel gear 8 forms an intermediate shaft and carries a spur pinion 10 meshing with a greater wheel 11 with which it forms the output stage.

Armature shaft 5 is centered by end shoulders of bevel pinion shafts 7 and mounted for free rotation. The torque produced is transmitted through a torsionally and flexually elastic coupling or clutch 12 so that the centering and supporting areas are bypassed. The armature of electric motor 4 is thus mounted in the motor-transmission block only indirectly, through the bevel pinion shafts 7 which are there mounted directly and in a statically determinate manner. Shafts 7 are rotatably mounted by bearings in housing 13. Miter gearing units 3 are symmetrical relative to electric motor 4 and so disposed that in a side elevation (FIG. 1), the lines connecting the centers of the intermediate shaft 9 and of axle shaft 2 of the two gearings at opposite sides, diverge downwardly. This arrangement ensures an ample ground clearance of the truck.

Figure 2:
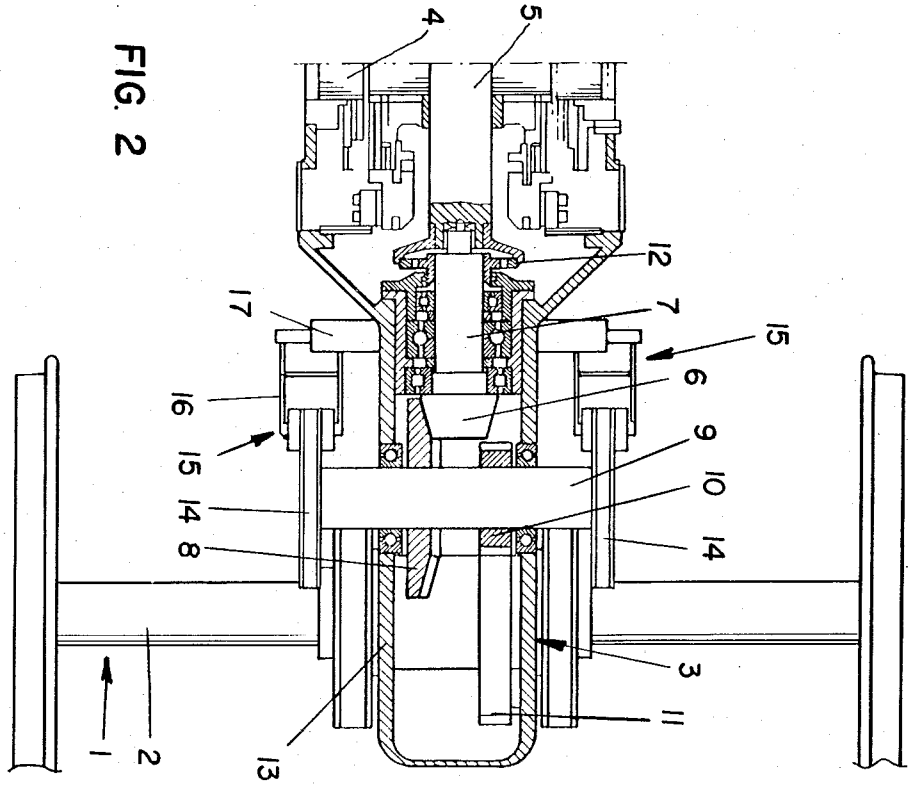
FIG. 2 is a top plan view partially in section of the right hand portion of the embodiment shown in FIG. 1.

As shown in FIG. 2, intermediate shaft 9 projects from the housing 13 of miter gearing 3 on both sides. On each of its ends, shaft 9 carries a brake disc 14 which comes to be engaged by a braking device or caliper structure 15, for example, braking jaws or calipers 16 associated with a brake cylinder 17. The two cylinders are secured to housing 13, so that no relative movements occur between brake disc 14 and braking devices 15.

The invention is thus stated as being a brake arrangement for a rail vehicle comprising, at least one track wheel set 1, having a track wheel shaft 2, a multi-stage reduction gear unit 3 connected to the wheel shaft 2 having a housing 13 and at least one intermediate power transmission shaft 9 rotatably mounted therein and extending therefrom, at least one brake disc 14 connected to said intermediate shaft 9, and caliper structure 15 engageable with said disc 14 to stop rotation of said disc and connected directly to said housing 13.

While a specific embodiment of the invention has been shown and described in detail to illustrate the application of the principles of the invention, it will be understood that the invention may be embodied otherwise without departing from such principles.

The embodiment of the invention in which an exclusive property or privilege is claimed is as follows:

1. A brake and drive arrangement for a rail vehicle comprising:

at least one track wheel set (1) having a track wheel shaft (2);

a multi-stage reduction gear unit (3) connected to said wheel shaft having a unit housing (13) and at least one intermediate power transmission shaft (9) rotatably mounted therein and extending therefrom said multi-stage reduction gear unit comprises a two-stage miter gearing unit, a bevel gear (8) connected to and carried by said intermediate shaft, a spur pinion (1) connected to said intermediate shaft, a spur gear (11) connected to said track wheel shaft and engaged with said spur pinion to form a slow spur gear stage, a drive shaft (7) having a pinion (6) engaged with said bevel gear and forming a fast bevel gear stage, and a bearing connected between said drive shaft and said housing for rotatably supporting said drive shaft;

at least one brake disc (14) connected to said intermediate shaft outside said housing;

an electric motor (4) having an armature spindle (5) extending in a direction of travel of the rail vehicle and having opposite ends;

an elastic coupling (12) connected between one of said armature spindle ends and said shaft for centering and rotatably supporting said armature shaft and for transmitting torque from said motor to said drive shaft;

an additional multi-stage reduction gear unit connected to an opposite end of said armature spindle, said additional multi-stage reduction gear unit having an additional intermediate power transmission shaft, and an additional unit housing;

an additional brake disc connected to said additional intermediate shaft; and caliper means engageable with each disc to stop rotation of each disc concurrently, and connected directly to each unit housing respectively;

said first mentioned and additional multi-stage reduction gear unit being formed as mirror images of each other on opposite sides of said electric motor, said electric motor having a motor housing rigidly connected to said first mentioned and additional multi-stage reduction gear unit housings.

* * * * *